US009393708B2

(12) United States Patent
Babaev

(10) Patent No.: US 9,393,708 B2
(45) Date of Patent: Jul. 19, 2016

(54) COMPOSITE SMOOTHING TOOL

(71) Applicant: Azer Babaev, Moscow (RU)

(72) Inventor: Azer Babaev, Moscow (RU)

(73) Assignee: Azer Babaev, Moscow (RU)

( * ) Notice: Subject to any disclaimer, the term of this patent is extended or adjusted under 35 U.S.C. 154(b) by 117 days.

(21) Appl. No.: 13/789,363

(22) Filed: Mar. 7, 2013

(65) Prior Publication Data

US 2014/0096400 A1 Apr. 10, 2014

(30) Foreign Application Priority Data

Mar. 9, 2012 (EP) ..... 12158864

(51) Int. Cl.
*B26B 27/00* (2006.01)
*B21D 53/60* (2006.01)
*E04F 21/24* (2006.01)

(52) U.S. Cl.
CPC ..... *B26B 27/00* (2013.01); *B21D 53/60* (2013.01); *E04F 21/241* (2013.01)

(58) Field of Classification Search
CPC ..... E04F 21/16; E04G 21/10; A47L 13/02; A47L 13/022; A47L 13/08; B08B 1/005; B05C 17/10
USPC ..... 30/169, 349, 329, 337, 338; D32/46; 15/235.4, 236.01, 245, 245.1
See application file for complete search history.

(56) References Cited

U.S. PATENT DOCUMENTS 92,034 A * 6/1869 Frey et al. ..... 15/245
252,822 A * 1/1882 Way ..... 15/236.01
358,234 A * 2/1887 Vache ..... 15/236.01
1,294,543 A * 2/1919 Sanford ..... 30/169
1,303,090 A * 5/1919 McCray ..... 30/349
1,541,373 A * 6/1925 Micek ..... 30/349
1,814,959 A * 7/1931 Parker ..... 30/349
1,956,587 A * 5/1934 Parker et al. ..... 30/349
2,030,833 A * 2/1936 Thompson ..... 30/169
2,261,475 A * 11/1941 Kautenberg ..... 15/245
2,497,482 A * 2/1950 Wilson ..... 30/349
2,772,435 A * 12/1956 Louk ..... 15/245
3,018,499 A * 1/1962 Levy ..... 15/235.4
3,302,233 A * 2/1967 Sebastiani ..... 15/235.4
4,017,970 A * 4/1977 Williams ..... 30/169

(Continued)

FOREIGN PATENT DOCUMENTS

CH 699 114 A2 1/2010
CN 103382764 A * 11/2013

(Continued)

OTHER PUBLICATIONS

European Search Report for the counterpart European patent application No. 12 15 8864.4 dated Jul. 9, 2012, 4 pages.

(Continued)

*Primary Examiner* — Jason Daniel Prone
(74) *Attorney, Agent, or Firm* — Kilpatrick Townsend & Stockton LLP

(57) ABSTRACT

A smoothing tool includes a grip part and a blade part accommodated therein. The grip part is formed as a light metal hollow profile and has two brackets clasping the blade part, and the blade part has at least one support rib and one or two clamping ribs at least partially clasping a respective one of the brackets of the grip part. A process for manufacturing the composite smoothing tool includes providing the blade part as a tailored cold drawn steel part.

15 Claims, 2 Drawing Sheets

(56) References Cited

U.S. PATENT DOCUMENTS

| | | | | | |
|---|---|---|---|---|---|
| 4,107,812 | A | * | 8/1978 | Lantto | 15/245 |
| 4,617,736 | A | * | 10/1986 | McCrary | 30/169 |
| 4,896,424 | A | * | 1/1990 | Walker | 30/349 |
| 5,048,184 | A | * | 9/1991 | Saxton | 30/169 |
| 5,307,536 | A | * | 5/1994 | Lescher | 15/245 |
| 5,337,523 | A | * | 8/1994 | Walsh | 15/245 |
| D366,130 | S | * | 1/1996 | Ordonez | D32/46 |
| 5,924,204 | A | * | 7/1999 | Lane | 30/169 |
| 6,260,280 | B1 | * | 7/2001 | Rapisardi | 30/349 |
| 6,453,970 | B1 | * | 9/2002 | Stone et al. | 15/245.1 |
| 6,681,439 | B1 | * | 1/2004 | Kohlruss et al. | 15/245 |
| 6,751,869 | B2 | * | 6/2004 | Paggeot | 30/169 |
| 7,204,659 | B2 | * | 4/2007 | Schmitt et al. | 404/118 |
| 7,651,296 | B2 | * | 1/2010 | Lindley | 404/118 |
| 7,774,940 | B2 | * | 8/2010 | Frank | 30/161 |
| 2005/0087084 | A1 | * | 4/2005 | Gray | 15/245 |
| 2006/0042035 | A1 | * | 3/2006 | Liu | 15/245 |
| 2006/0101649 | A1 | * | 5/2006 | Chen | 30/349 |
| 2006/0254009 | A1 | * | 11/2006 | Tsai et al. | 15/245 |

FOREIGN PATENT DOCUMENTS

| | | | | |
|---|---|---|---|---|
| DE | 20 2009 017282 | U1 | | 11/2010 |
| EP | 2636818 | A1 | * | 9/2013 |
| ES | 2488860 | T3 | * | 8/2014 |
| JP | 2013185438 | A | * | 9/2013 |
| WO | 94/12318 | A1 | | 6/1994 |

OTHER PUBLICATIONS

First Office Action, dated Apr. 28, 2015, for Chinese Patent Application No. 2013/10138999.1 (English Translation Only), 3 pages.

* cited by examiner

COMPOSITE SMOOTHING TOOL

CROSS-REFERENCES TO RELATED APPLICATIONS

The present application claims priority to European Patent Application No 12 158 864.4, filed on Mar. 9, 2012, the disclosure of which is hereby incorporated by reference in its entirety.

BACKGROUND OF THE INVENTION

The present invention relates to a composite smoothing tool and a process for manufacturing it.

A related two-part scraping and smoothing tool is known from the Swiss patent application CH 699 114 A2. In the tool described in this document, a steel blade having a holding rib is form fitted in an L-shaped recess in an aluminum hollow profile having support brackets. The blade is slid sideways into the recess and then fixed against displacement by covers attached to the side surfaces of the scraping and smoothing tool.

The known tool has been found occasionally not to be able to withstand the stresses and strains of everyday use. It is therefore desirable to have at hand a sturdier tool.

SUMMARY OF THE INVENTION

The invention relates to a composite tool in which two brackets of a light metal hollow profile grip part hold a steel blade form fittingly and in frictional connection, and one or two clamping ribs clasp the corresponding bracket(s), so as to increase the frictional force. Thereby further fixing means are not necessary, but the tool is still able to withstand extraordinary stresses and strains.

In embodiments, the blade has an arrow shaped cross section and one or two support ribs accommodated in support grooves of the grip part. In further embodiments, the grip part has an inside rib, preferably arranged between two opposing grip recesses formed in parallel faces of a trapezoidal hollow profile. In some embodiments, the rearward face of the grip part is perpendicular to the faces adjacent to it.

In some embodiments, the steel for the blade is cold drawn, thereby increasing its hardness and wear resistance. In still further embodiments, the blade is at least partially coated to increase corrosion resistance where the brackets of the aluminum grip part clasp the steel blade.

Under another aspect, the invention provides a process of gradually cold drawing the blade steel into a shape having a cutting edge, a rearward extension with at least one support rib and one or two clamping ribs extending obliquely from the cutting edge towards the rearward extension, cutting it to a desired length and introducing the tailored blade part into a respective collet in an aluminum grip part. Similarly as in the above, in this manner the steel blade is securely held by the frictional forces eliminating the need for separate fixing steps. In embodiments, the steel blade may be coated with an insulating film before introducing it into the collet, at least at parts where direct contact to aluminum is to be avoided in order to increase corrosion resistance.

According to an embodiment of the present invention, a smoothing tool with a grip part and a blade part accommodated in the grip part is provided. The grip part is formed as a light metal hollow profile having brackets clasping the blade part and the blade part includes at least one support rib accommodated in a respective support groove of the grip part. The blade part further includes one or two clamping ribs at least partially clasping a respective one of the brackets of the grip part.

According to another embodiments of the present invention, a process for manufacturing a composite smoothing tool is provided. The process includes providing a light metal grip part with a blade part collet, and sideways introducing a steel blade part into same. The process further includes gradually cold drawing the blade steel into a shape having a cutting edge, a rearward extension with at least one support rib and one or two clamping ribs extending obliquely from the cutting edge towards the rearward extension. The process further includes cutting the cold drawn blade steel to a length corresponding to a width of the collet to provide the steel blade part.

BRIEF DESCRIPTION OF THE DRAWINGS

Further aspects and advantages will become apparent from the detailed description below, and by reference to the appended drawings. These show.

DETAILED DESCRIPTION OF THE INVENTION

Figure 1:
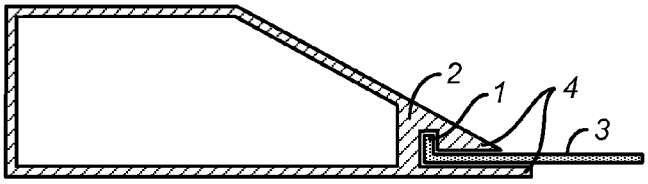
FIG. 1 (PRIOR ART)
FIG. 1 illustrates a conventional smoothing tool in cross section.

In the drawing of FIG. 1, a conventional tool is shown in cross section: A steel blade 3 having a holding rib 1 is slid sideways into an L-shaped recess formed between two brackets 4 of an aluminum hollow profile 2 constituting the grip part.

Figure 2:
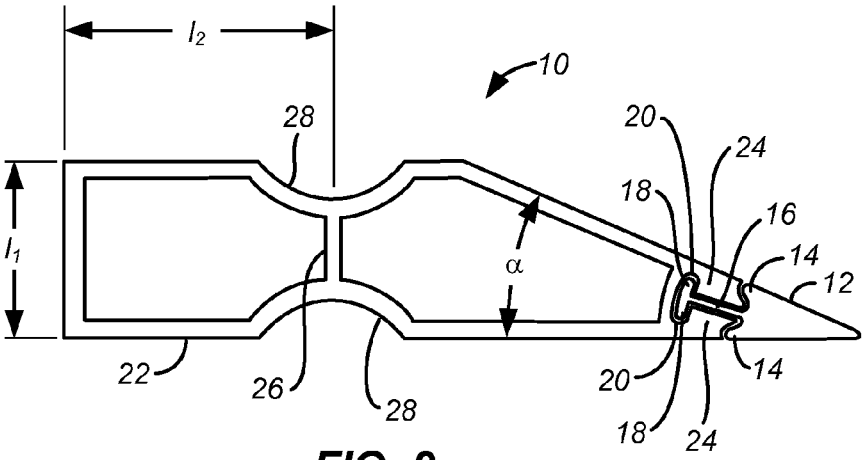
FIG. 2 illustrates an embodiment of the invention in cross section.
Figure 3:
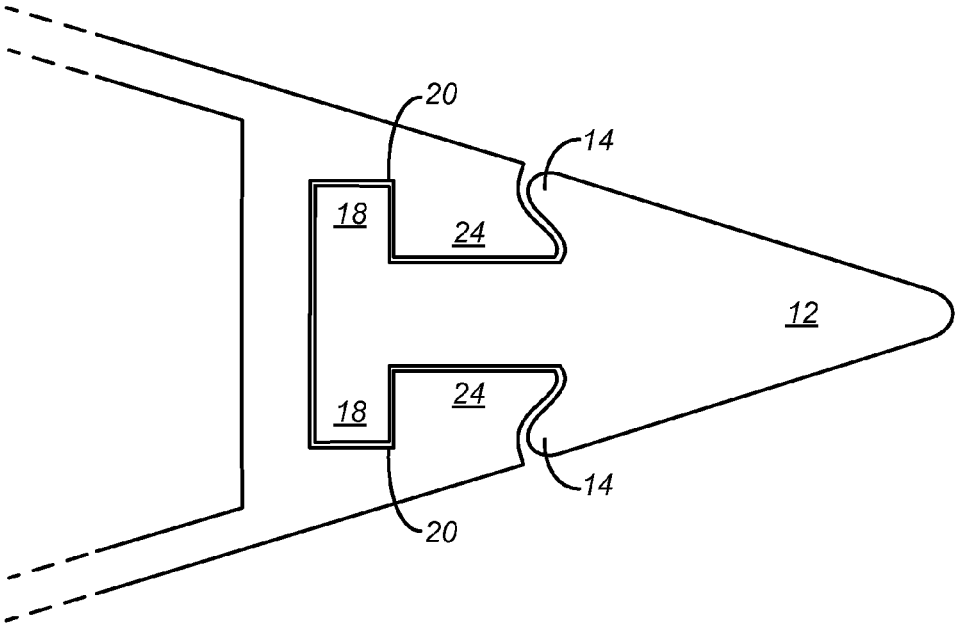
FIG. 3 illustrates another embodiment of the invention in a close-up view.

In contrast to the tool of FIG. 1, the tool 10 according to the invention (FIGS. 2+3) has a blade part 12 which has two clamping ribs 14 together with a rearward extension 16 providing an arrow shape. At the rearward extension, there are two oppositely projecting support ribs 18 engaging into corresponding recesses 20 of the grip part 22. Between the clamping ribs 14 and the support ribs 18, the grip part has clasping brackets 24 forming a collet for the blade part 12.

In cross sections parallel to the length direction of the blade part and orthogonally to the rearward extension 16, the clamping ribs 14 are spaced from the rearward extension 16. In other words, in length direction of the blade part 12 a recess for receiving the clasping brackets 24 of the grip part 22 is formed between the clamping ribs 14 and the rearward extension 16 of the blade part 12.

According to embodiments, the blade part has a curvature encircling an angle of between 100° and 160° at a tip portion opposing the rearward extension 16. Furthermore, the blade part may have a curvature encircling an angle of more than 100° at a protruding portion of the at least one clamping rib 14, the protruding portion being the part of the at least one clamping rib that is located most distant from the tip portion of the blade part. Alternatively or additionally, the blade part may have a curvature encircling an angle of more than 100° at a connection portion between the at least one clamping rib 14 and the rearward extension 16.

The grip part 22 is of generally prismatic or trapezoidal shape, the latter having two parallel faces in each of which a grip recess 28 is formed for ease of holding the tool. On the inside of the tool's hollow profile, made of aluminum or an aluminum-base alloy, a reinforcement rib 26 is formed between the grip recesses 28. The rearward face of the trapezoid is in this embodiment perpendicular to the adjacent faces. Of course, the general shape of the tool is ergonomic, therefore the rearward edges are appropriately rounded so as not to cause pain when held in use. For the same reason, suitable thicknesses l1 will be within 25±10 mm between the parallel faces, a width l2 will be within 35±10 mm between the rearward face and the deepest point of the grip recess 28, and an angle α of the blade holding part is ca. 15-30°, in embodiments preferably 20-25°.

The steel blade has an additional function of clasping the brackets 24 of the grip part, requiring particular attention to its manufacturing. It has been found that particularly suitable blades can be made by cold drawing, adding to the hardness and wear resistance and also providing elasticity to the clamping ribs 14. The process for manufacturing accordingly includes gradually cold drawing the blade steel into a shape having a cutting edge, a rearward extension with at least one support rib and two clamping ribs extending obliquely from the cutting edge towards the rearward extension and subsequent cutting of the blade steel, in embodiments followed by film coating and then introducing it into the collet provided by the grip part brackets 24. The frictional forces resulting in this manner are sufficient to securely support the blade without any danger of it ever inadvertently coming loose.

Figure 4A:
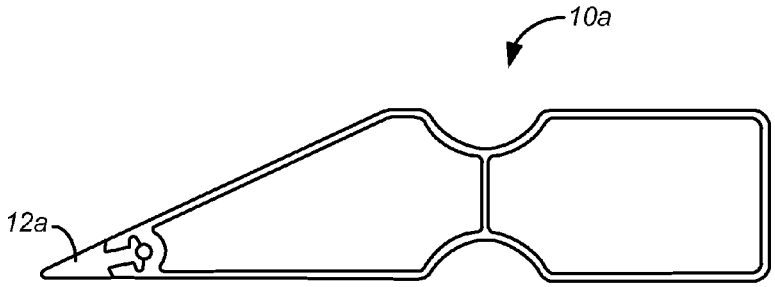
FIGS. 4A-D provide several views of another embodiment.
Figure 4B:
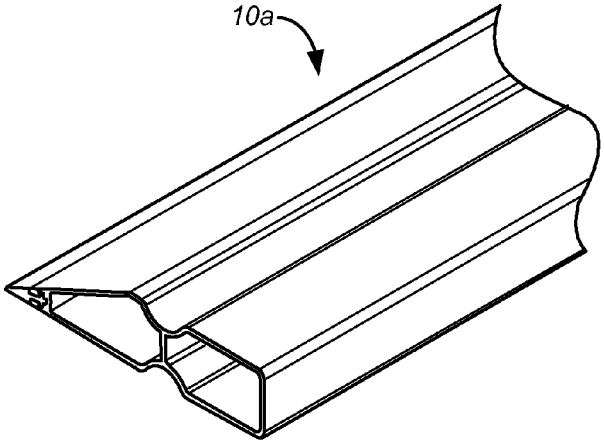
Figure 4C:
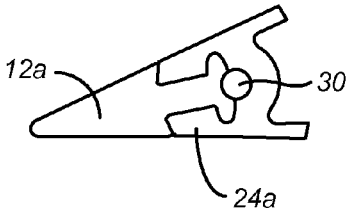
Figure 4D:
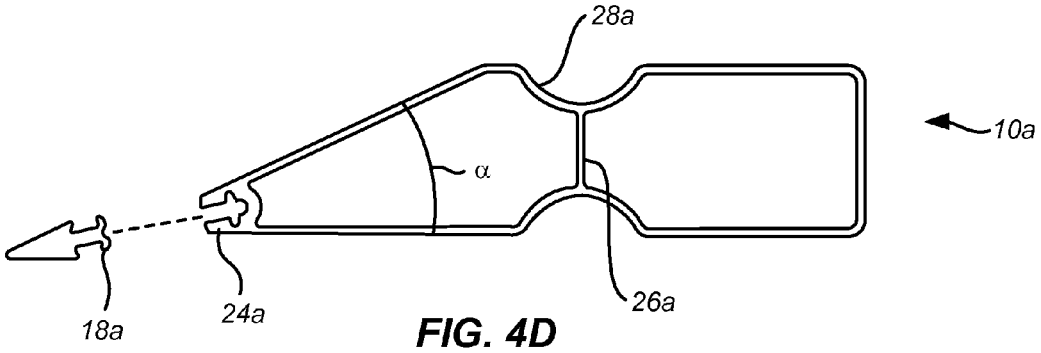

In another embodiment shown in FIGS. 4A to 4D, the tool 10*a* has a very similar shape, as has a blade part 12*a* inserted. FIG. 4A shows a cross section, FIG. 4B an overall view, and FIG. 4C shows but the blade part 12*a* in close-up. FIG. 4D shows both the tool 10*a* the blade part 12*a*, the support ribs 18*a*, clasping brackets 24*a*, reinforcement rib 26*a*, and grip recesses 28*a* indicating where the part 12*a* is inserted (actually along a line perpendicular to the paper plane). The difference in this embodiment is that when the blade part 12*a* is inserted into the grip part 10*a*, a hole 30 remains. The angle α in this embodiment is identical to the one of the previously described embodiment of FIG. 2.

The skilled person will be aware of modifications to the above embodiments feasible without departing from the scope of the invention as defined by the appended claims.

What is claimed is:

1. A smoothing tool with a grip part and a blade part, wherein the grip part is formed as an aluminum or aluminum alloy hollow profiled body including an inner rib inside the hollow profiled body, two brackets, and two oppositely arranged recesses, wherein at least one support groove is formed on an inside of at least one of the two brackets, and wherein the inner rib extends from one of the two oppositely arranged recesses to the other of the two oppositely arranged recesses, and the blade part includes a rearward extension and at least one support rib formed on said rearward extension, said at least one support rib being accommodated in the at least one support groove, wherein the blade part further includes two clamping ribs each arranged, together with said rearward extension and the at least one support rib, to clamp the at least one of the two brackets between a respective one of the clamping ribs, the rearward extension, and the at least one support rib wherein the at least one support rib has a first hole forming recess and the at least one support groove has a second hole forming recess, and wherein the first hole forming recess and the second hole forming recess together define a hole.

2. The smoothing tool of claim 1, wherein the two clamping ribs cover a respective portion of the two brackets, and a portion of the two brackets is exposed.

3. The smoothing tool of claim 1, wherein the two clamping ribs extend obliquely towards the hollow profiled body.

4. The smoothing tool of claim 1, wherein the at least one support rib comprises two support ribs, and the at least one support groove comprises two support grooves, one on an inside of each of the two brackets.

5. The smoothing tool of claim 1, wherein the aluminum alloy comprises, by mass, mainly aluminum.

6. The smoothing tool of claim 1, wherein the blade part is symmetrical with respect to a blade plane defined by a length of the blade part, a tip of the blade part, and a center of the rearward extension.

7. The smoothing tool of claim 1, wherein the blade part and the brackets are joined with only frictional forces.

8. The smoothing tool of claim 1, wherein the blade part is formed from cold drawn steel.

9. The smoothing tool of claim 8, wherein at least a portion of the blade part is corrosion-protection coated.

10. The smoothing tool of claim 9, wherein the two clamping ribs extend obliquely towards the hollow profiled body.

11. The smoothing tool of claim 9, wherein the at least one support rib includes two support ribs, and the at least one support groove comprises two support grooves, one on an inside of each of the two brackets.

12. The smoothing tool of claim 1, wherein the hollow profiled body has a trapezoidal cross section.

13. The smoothing tool of claim 12, wherein a face of the hollow profiled body distal to the blade part is perpendicular to adjacent faces of the hollow profiled body.

14. A smoothing tool with a grip part including metal and a blade part, wherein the grip part is characterized by a hollow profile and includes two brackets and a support recess, the blade part includes at least one support rib accommodated in the support recess of the grip part, the blade part further includes two clamping ribs, wherein the two clamping ribs cover a respective portion of the two brackets, and a portion of the two brackets is exposed, the blade part is formed from cold drawn steel, at least a portion of the blade part being corrosion-protection coated, and the clamping ribs extend obliquely towards the grip part, wherein the at least one support rib has a first hole forming recess and the support recess has a second hole forming recess, and wherein the first hole forming recess and the second hole forming recess together define a hole.

15. The smoothing tool of claim 14, wherein the support recess of the grip part comprises two oppositely arranged recesses.

* * * * *